United States Patent [19]

Preston

[11] Patent Number: 4,883,118

[45] Date of Patent: Nov. 28, 1989

[54] COMBINATION TUBING CUTTER AND RELEASING OVERSHOT

[76] Inventor: Clyde N. Preston, 110 Oakshire Dr., Houma, La. 70364

[21] Appl. No.: 272,401

[22] Filed: Nov. 17, 1988

[51] Int. Cl.[4] ..... E21B 31/16; E21B 31/18

[52] U.S. Cl. ..... 166/55.3; 166/98; 294/86.26; 294/86.3; 294/86.34

[58] Field of Search ..... 166/55, 55.1, 55.2, 166/55.3, 55.6, 55.7, 55.8, 98, 297, 298, 376; 175/423; 294/86.19, 86.2, 86.26, 86.3, 86.33, 86.34

[56] References Cited

U.S. PATENT DOCUMENTS

| | | | |
|---|---|---|---|
| 1,015,432 | 1/1912 | Frederickson . | |
| 1,471,775 | 10/1923 | Brown | 294/86.33 |
| 1,747,513 | 2/1930 | Kammerdiner . | |
| 1,790,783 | 2/1931 | Yungling | 166/55.2 |
| 1,813,368 | 7/1931 | Toles . | |
| 2,277,580 | 3/1942 | Carothers | 166/55.6 |
| 2,304,793 | 12/1942 | Bodine, Jr. | 166/55 |
| 2,934,147 | 4/1960 | Baker | 166/63 |
| 3,174,548 | 3/1965 | Webb | 294/86.34 |

*Primary Examiner*—Jerome W. Massie
*Assistant Examiner*—Terry Lee Melius
*Attorney, Agent, or Firm*—Charles Fallow; Martin Hoffman

[57] ABSTRACT

A mechanical tubing cutter for severing and retrieving fish from wells comprises a slip body for clamping the upper end of the fish, and cam-actuated cutter knives for severing the fish below the slip body. The clamping and cutting operations occur in an automatic and predictable sequence as upward force is progressively applied to the tool. The tool may be used as a releasing overshot merely by substituting a slip body setting sleeve for the cutter knives.

15 Claims, 4 Drawing Sheets

COMBINATION TUBING CUTTER AND RELEASING OVERSHOT

BACKGROUND OF THE INVENTION

This invention relates to a combination tool for use in oil well drilling and production. The tool performs both cutting and retrieving functions within a well bore.

Prior tubing cutters of various types are known, including exposive devices and tools having cutter knives operated by hydraulic pistons to which fluid pressure is directed from the surface. Hydraulic cutters tend to be complex, and therefore expensive and difficult to operate, and explosive devices have well-known shortcomings and dangers Furthermore, none of the prior devices is capable of both cutting a fish and retrieving it from the well in a single operation.

Purely mechanical tubing cutters are also well known. These, as a rule, require that the tubing supporting the tool be rotated at the surface when it is desired to perform a cut. A problem associated with tools actuated by rotary motion occurs when well bores are highly deviated, that is, not straight. Such bores may deviate from the vertical by over 60° . In such cases, wall friction between the casing and the tubing makes rotary motion very difficult to impart and control from the surface.

SUMMARY OF THE INVENTION

It is therefore an object of this invention to provide a mechanical tubing cutter capable of grasping heavy fish with sufficient force to lift the fish out of the well, and to provide a purely mechanical tool which executes clamping, cutting and retrieving steps in automatic sequence.

Another object is to provide such a tool which is actuated by a linear lifting force, rather than by rotation, and which performs the clamping, cutting and retrieving steps at predictable force levels.

A further object is to provide a tubing cutter which can be easily be converted to a releasing overshot.

The present invention is embodied in a tubing cutter comprising a hollow cylindrical housing containing: a cutter assembly having plural knives with inclined upper cam surfaces, a slip body above the cutter, the body comprising plural cam-operated slips for clamping the tubing by applying radial force thereto, and having a lower conical surface for engaging the upper cam surfaces of the knives, a slip actuator above the slip body, the acutator having a lower conical surface for actuating the slips, and means, above the slip actuator, for engaging a projection on the tubing. The engaging means, the actuator and the slip body are all retained in installed axial positions within the housing by first, second and third shear pins, respectively, the pins having different strengths so as to fail progressively, the first pin being the weakest of the three and the third pin being the strongest. When the device is placed over the tubing and then pulled upward toward the projection with progressive force, the tubing is first engaged by the engaging means, then clamped by actuation of the slips, and then cut by actuation of the cutter.

BRIEF DESCRIPTION OF THE DRAWINGS

A tool embodying the is shown in the accompanying drawings, wherein.

DESCRIPTION OF THE PREFERRED EMBODIMENT

Figure 1:
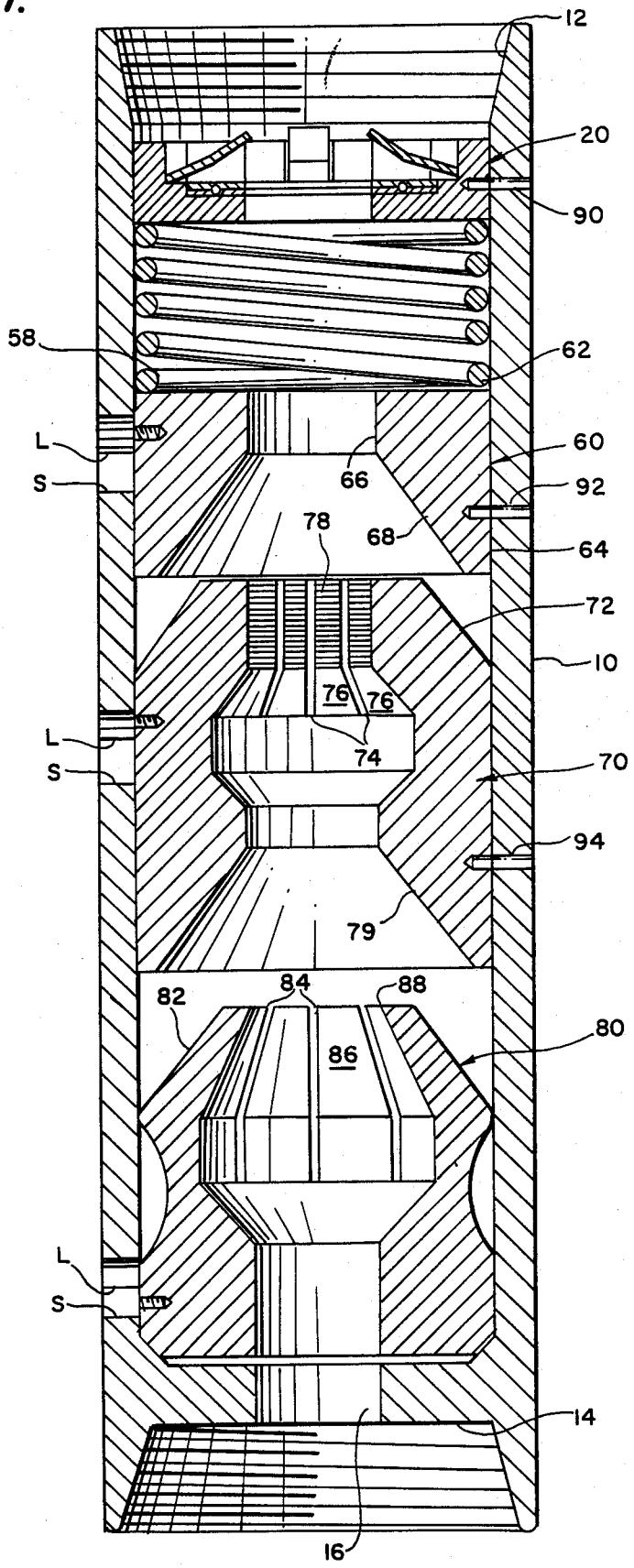
FIG. 1 is a cross-sectional view of a tubing cutter embodying the invention, taken along a plane containing the longitudinal axis of the tool.

A tubing cutter embodying the invention includes a cylindrical hollow housing 10 having an open upper end internally threaded at 12 for attachment at the bottom of a wash pipe (not shown). The housing has an integral, annular bottom or "driving ring" 14 with a bore 16 sufficiently large to pass over drill string collars and the like. The housing contains four major components, capable of linear movement with respect to one another within the housing. From top to bottom, these components are: a dog assembly 20 for engaging tubing shoulders or collars in a cutting or fishing operation; a slip body actuator 60; a collet-type slip body 70; and a collet-type cutter 80. The cutter rests normally on the bottom 14 of the housing 10. The cutter, slip body, and actuator each have a pairs of lugs L which extend through corresponding vertical slots S in the housing wall to delimit the vertical motion of each.

Figure 3:
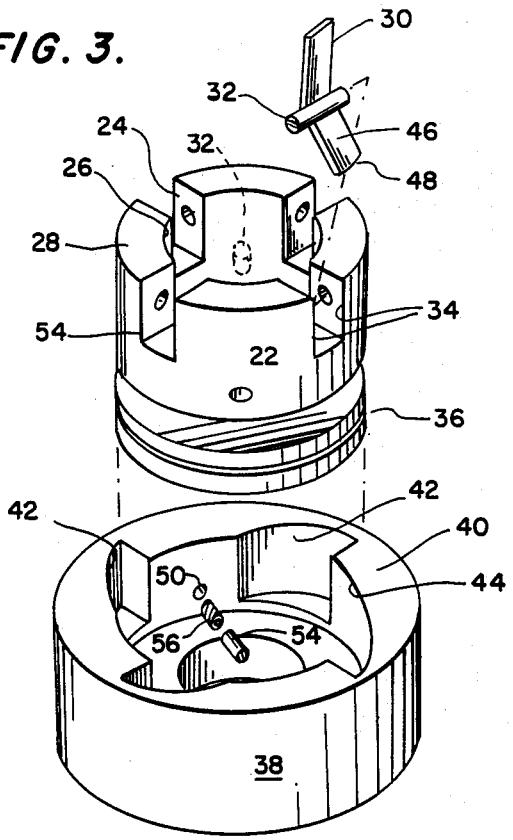
FIG. 3 shows the dog assembly of the invention in exploded isometric.
Figure 4:
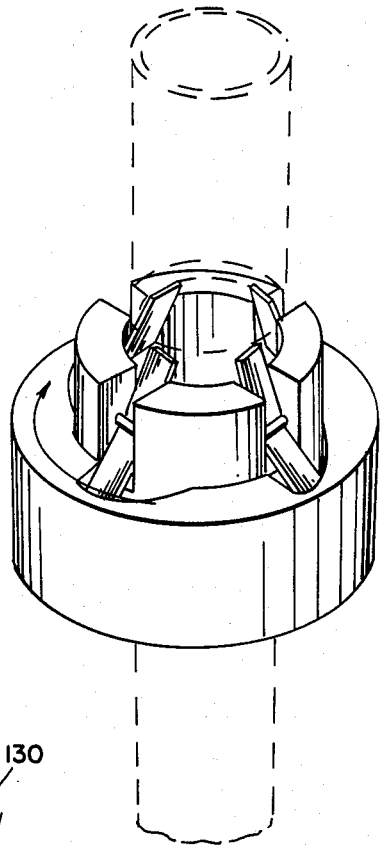
FIG. 4 is an isometric view illustrating operation of the dog assembly.

Of the assemblies contained within the housing, the dog assembly 20 is uppermost. This assembly, shown in detail in FIGS. 3 and 4, comprises a cage 22 having four equally spaced slots 24 extending radially from the inside diameter 26 to the outside diameter 28 of the cage. A dog 30 is retained within each of the slots, for pivoting movement about a pin 32 which extends through the dog and into the sides 34 of the cage slot. Each dog has a flattened "V" shape and is pinned at the intersection of the legs of the "V".

The cage 22 rests on an antifriction thrust bearing 36 within a cup-shaped dog cam ring 38 having a peripheral annular wall 40. Four equally spaced cam surfaces 42, one facing each of the dogs, are formed on the inner wall surface 44. The lower wing 46 of each dog has a rounded end 48 generally conforming to the shape of the cam surfaces. Clockwise rotation of the ring relative to the cage causes the cam surfaces to push the lower ends of the dogs radially inward, forcing each dog to a more vertical orientation to release a tubing shoulder engaged by the dogs. The necessary rotation is transmitted to the ring from the drill string by a coil spring 58, described below.

The annular wall 40 of the release ring has a radially extending blind hole 50 in its inner surface 44, disposed between an adjacent pair of the cam surfaces 42. The cage 22 has a corresponding hole 52 in its outer surface 54, so positioned that the two holes 50,52 are aligned only when the dogs are in their fully released position. The dog cam ring and cage are assembled with these holes misaligned, in relative positions corresponding to the locking position of the dogs, and a hardened pin 54 is installed in the blind hole in the release ring, with a spring 56 behind it. When the dog cam ring is turned to the release position, as explained below, the pin 54 latches into the hole 52 in the cage, so as to lock the ring and cage in the open position and to thereby prevent further relative rotation.

A right-hand helix coil compression spring 58 (FIG. 1), having an outer diameter about equal to the inner diameter of the housing 10, is positioned below and in contact with the bottom surface of the dog cam ring; the end of the spring is preferably seated in a groove in the ring to prevent relative rotation of the parts. The lower end of the spring is supported on the upper surface of the next lower component, the floating slip body actuator 60, and is correspondingly seated at that point.

The actuator 60 has a flat upper surface 62, an outer diameter 64 that is a sliding fit in the housing, an inner diameter 66 sufficiently large to pass over any fish, and an upwardly converging frustoconical bottom surface 68. The lugs L extending outwardly from the outer diameter of the floating slip body cone into the vertical slots S in the housing to prevent relative rotation.

The slip body 70 is a unitary body comprising a sleeve with a frustoconical upper surface 72 having the same apex angle as the bottom surface 68 of the actuator. A plurality of radially extending slots 74 opening inwardly to the bore of the slip body define plural resilient slip body fingers 76, which are provided with serrated inner surfaces 78 for engaging the wall of a tube. The fingers are internally undercut to make them sufficiently resilient. The bottom surface 79 of the slip body defines the frustum of an upwardly converging cone.

The cutter body 80, like the slip body, is unitary, and has an upper frustoconical surface 82 with an apex angle like that of the bottom surface 79 of the slip body. The upper portion of the body is divided by radial slots 84 into a plurality of knives 86 having inwardly directed chisel edges 88 at their upper ends. The knives are exteriorly undercut so as to have adequate resilience.

The dog assembly, actuator, and cutter are retained in their installed positions, with gaps therebetween, by shear pins 90, 92 and 94 designed to fail at different, predetermined axial force levels. The dog assembly retaining pin 90, for example, is rated at 2500 lbs.; the actuator pin 92 is designed to fail at 10,000 lbs.; and the slip body pin 94 fails at 20,000 lbs. shear. The shear pins provide sequential, predictable clamping and cutting events, and insure that the upper portion of that which is cut remains retained by the tool for immediate removal from the well.

Figure 5:
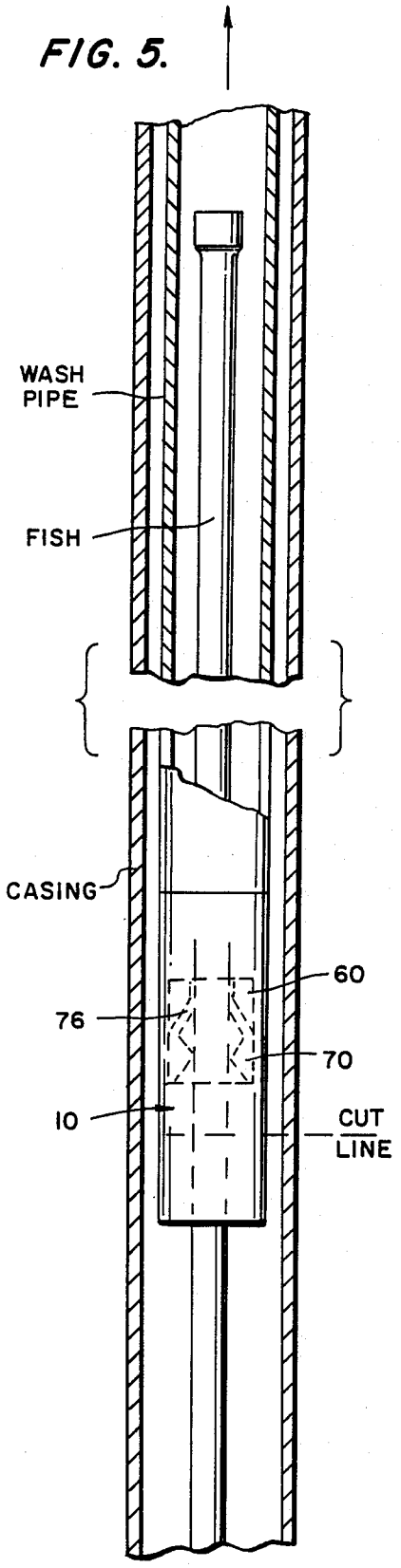
FIG. 5 shows the tool in clamping engagement with a fish, prior to cutting.
Figure 6:
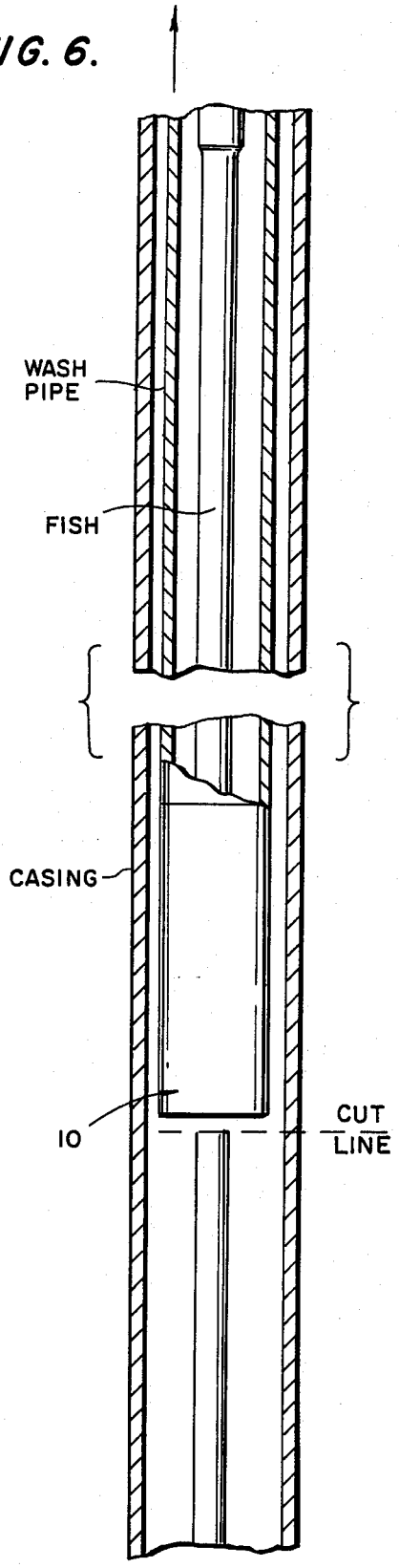
FIG. 6 shows the severed fish being removed from a well bore.

In operation, the tool is run down the well and over the end of the fish. Once the tool is at the desired point on the fish, it is retracted until the dogs engage a shoulder or collar on the fish, as shown in FIG. 5. The upward force on the tool maintains the dogs in firm engagement beneath the shoulder thereafter. The lifting force is then progressively increased. As the shear pin 90 fails, the dog assembly moves toward the actuator, compressing the spring 58. At a lifting force of 10,000 pounds, the shear pin 92 fails, allowing the spring to drive the actuator downward against the slip body, closing the slip body fingers around the tubing. This position is illustrated in FIG. 5. Subsequently, when the lifting force reaches 20,000 pounds, the shear pin 94 is broken, and the slip body is driven downward against the cutter 80, forcing the cutter knives inward against the tubing. The tool may be jarred up and down to complete the cut if necessary. Once the fish is cut, its upper portion, still in the grip of the slip body fingers, may be lifted safely from the well, as shown in FIG 6.

When desired, the cutter knives and slip body may be retracted by bumping the tool downward, sufficiently that the tops of the slots S strike the lugs L. The heights of the slots are selected so that the parts are deactivated in the reverse order of the sequence in which they were activated.

Figure 2:
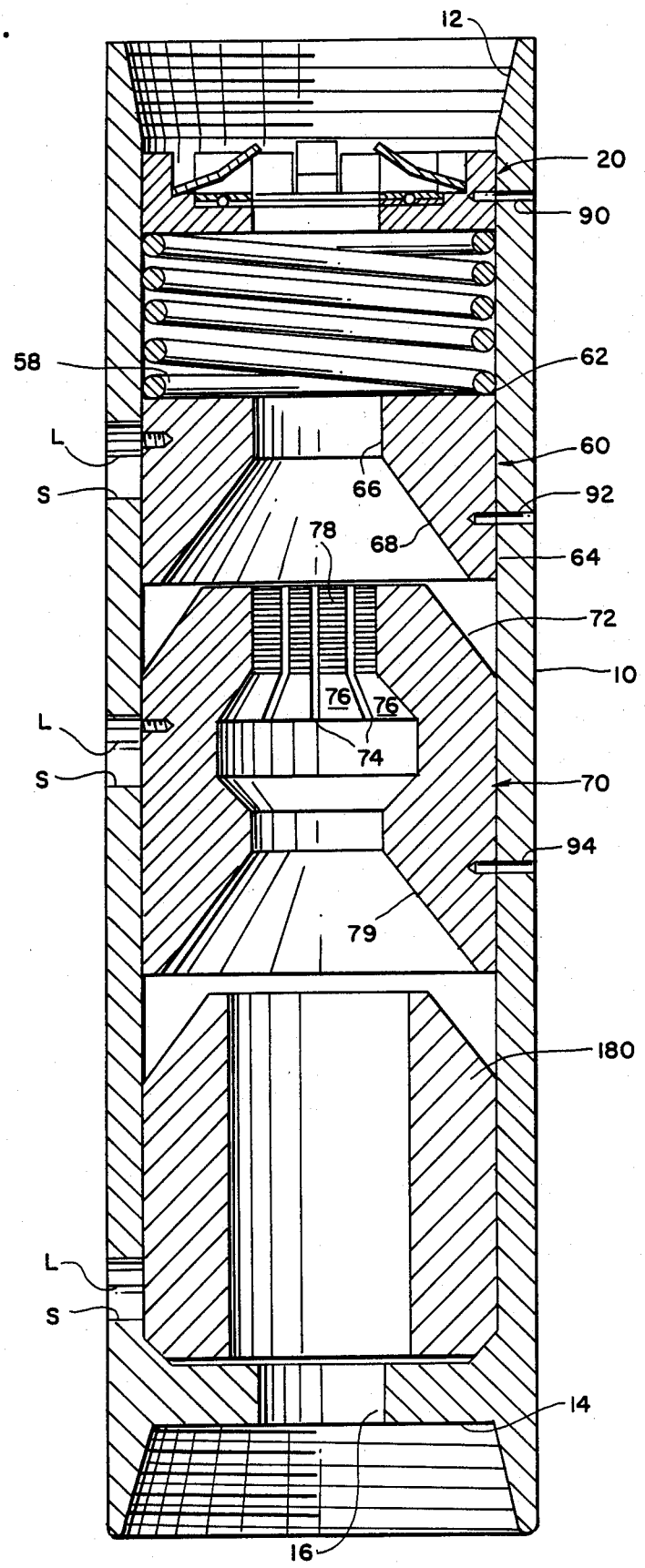
FIG. 2 shows an alternative form of the tool, useable releasing overshot.

The tool described above may be converted to a releasing overshot merely by replacing the cutter with a simple sleeve 180, as shown in FIG. 2. Now, when the tool is run over a fish, the dogs engage beneath a shoulder of the fish to engage it a provide the resistance to lifting necessary to actuate the tool. Once sufficient force is applied to break the first and second shear pins, the actuator drives the slip body fingers against the exterior of the fish, to clamp it. As the third pin breaks, no cutting occurs, but the upward force created on the clip by the sleeve increases the compression of the slip body fingers, thus enabling extremely heavy fish to be lifted. If, however, the fish is stuck and cannot be removed, the releasing dog feature of the invention permits the supervisor to disengage the dogs from the fish shoulder (by rotating the drill string, and thus, the dog assembly dog cam ring 38) and remove the tool, without damaging it. In the past, it has been necessary to break off the dogs in order to disengage the overshot from the fish.

Figure 7:
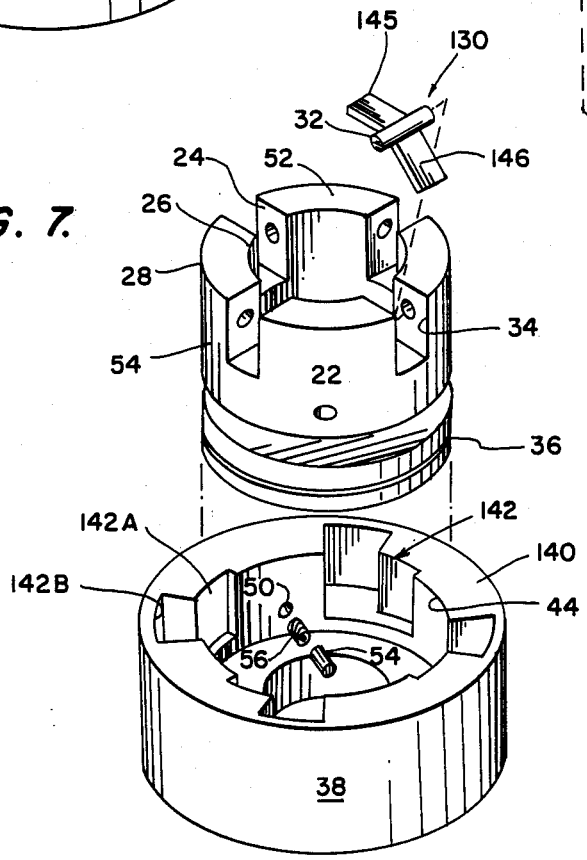
FIG. 7 shows a variation of the dog assembly, corresponding to FIG. 3.

FIG. 7 shows a variation of the dog assembly wherein the cam surfaces of the dog cam ring 140 are replaced by stepped recesses designated generally as 142, each comprising a shallow recess 142A adjacent a deeper recess 142B. In this embodiment also, the dogs 130 have a radially inner wing 145 and an outer wing 146 with a negative dihedral angle therebetween, so that the dogs pivot downward to release the fish, rather than upward. Otherwise, the assemblies are identical, as shown by identical reference numerals, and operation of the assembly is very similar to that described above. It can be seen that clockwise rotation of the ring 140 permits the dog wing 145 to fall downward, to release the fish.

Inasmuch as the invention is subject to variations, it is intended that the foregoing description and the accompanying drawings shall be interpreted merely as illustrative of the invention, which is to be measured by the following claims.

I claim:

1. A tubing cutter comprising a hollow cylindrical housing containing:

a cutter assembly having plural knives with inclined upper cam surfaces, a slip body above said cutter, said body comprising plural cam-operated slips for clamping said tubing by applying radial force thereto, and having a lower conical surface for engaging the upper cam surfaces of said knives, a slip actuator above said slip body, said acutator having a lower conical surface for actuating said slips, and means, above said slip actuator, for engaging a projection on said tubing, said engaging means, said actuator and said slip body all being retained in installed axial positions within said housing by first, second and third shear pins, respectively, said pins having different strengths so as to fail progressively, the first pin being the weakest of the three and the third pin being the strongest, whereby when said device is placed over a length of tubing and then pulled upward toward said projection with progressive force, the tubing is first engaged by said engaging means, then clamped by actuation of the slips, and then cut by actuation of the cutter.

2. The invention of claim 1, wherein said cutter assembly is a unitary body comprising a ring with said knives integrally connected at the upper end thereof, said knives being resilient in the radial direction.

3. The invention of claim 2, wherein each of said knives has an radially inwardly facing cutting edge at its upper end.

4. The invention of claim 1, wherein said slip body is a unitary body comprising a ring with said slips integrally connected at the upper end thereof, said slips being resilient in the radial direction.

5. The invention of claim 1, wherein said engaging means comprises a dog assembly including a cage, a plurality of dogs pivotally supported by the cage, and a dog cam ring for controlling the position of the dogs.

6. The invention of claim 5, wherein said dog cam ring is rotatable with respect to said cage, and further comprising means for rotating said dog cam ring with respect to said cage, and wherein said dog cam ring includes an annular wall having a plurality of recesses in its inner surface, each of said recesses having a radial surface varying in radial depth, and in contact with a portion of a respective one of said dogs, whereby the position of the dogs in determined by the angular position of the ring with respect to the cage.

7. The invention of claim 6, wherein the radial surface of each recess is a ramp.

8. The invention of claim 6, wherein the radial surface of each recess comprises at least two steps.

9. The invention of claim 5, wherein said cage is provided with a race having a semi-round groove and said cage is provided with a race having a semi-round groove therein, and further comprising a series of ball bearings contained between said races, within said grooves.

10. A dog assembly for engaging a collar on an elongate member, said assembly comprising a hollow cage adapted to pass over said member and said collar, a plurality of dogs each pivotally mounted on said cage so as to be movable between a first position in engagement with said collar and a second position out of engagement with said collar, a dog cam ring, rotatable about and with respect to said cage, for controlling movement of said dogs from said first position to said second position, said ring comprising an inner circumferential wall having a plurality of radially extending recesses therein, one for each dog, said dogs being disposed so that a portion of each dog bears against a radially outer wall of a respective recess, each of said recesses having a radial depth varying in the circumferential direction, whereby the dog position is determined by the angular position of the ring relative to the cage.

11. The invention of claim 10, further comprising means for latching said ring to said cage in a position corresponding to said second dog position.

12. The invention of claim 11, wherein said cage has a radially facing bore in its outer surface and said ring has a radially facing bore in the inner surface of its annular wall, said bores being aligned in said position corresponding to said second dog position, said latching means comprising a spring-biased pin installed in one of said bores.

13. The invention of claim 10, wherein the radial surface of each of said recesses is a ramp which forces a portion of said dog inward when the ring is rotated from said first position to said second position.

14. The invention of claim 10, wherein the radial surface of each of said recesses comprises a pair of steps which allow a portion of said dog to move outward when the ring is rotated from said first position to said second position.

15. A dog assembly for engaging a projection on an elongate member extending therethrough, said assembly comprising a hollow cage, a plurality of dogs each pivotally mounted on said cage so as to be movable between a first position in engagement with said projection and a second position out of engagement with said projection, a dog cam ring for controlling movement of said dogs from said first position to said second position, said ring comprising an annular wall having a plurality of radially extending recesses therein, one for each dog, said recesses having a radial depth varying in the circumferential direction, whereby the dog position is determined by the angular position of the ring relative to the cage.

and means for latching said ring to said cage in a position corresponding to said second dog position, wherein said cage has a radially facing bore in its outer surface and said ring has a radially facing bore in the inner surface of its annular wall, said bores being aligned in said position corresponding to said second dog position, said latching means comprising a spring-biased pin installed in one of said bores.

* * * * *